United States Patent [19]

Garner et al.

[11] 4,256,930

[45] Mar. 17, 1981

[54] LOUDSPEAKER HAVING IMPROVED MAGNETIC ASSEMBLY

[75] Inventors: Alex V. Garner, High Wycombe; Graham Townsend, Chinnor, both of England

[73] Assignee: Tannoy Products Limited, High Wycombe, England

[21] Appl. No.: 7,376

[22] Filed: Jan. 29, 1979

[30] Foreign Application Priority Data

Feb. 22, 1978 [GB] United Kingdom ..... 7108/78

[51] Int. Cl.[3] ..... H04R 11/02

[52] U.S. Cl. ..... 179/116; 179/115.5 H; 179/115.5 PC; 179/119 R

[58] Field of Search ..... 179/115.5 DV, 115.5 PS, 179/115.5 PC, 116, 117, 119 R, 120, 115.5 H

[56] References Cited

U.S. PATENT DOCUMENTS 2581223 1/1952 Voigt ..... 179/119 R

FOREIGN PATENT DOCUMENTS 981010 5/1951 France ..... 179/115.5 PC
442900 2/1936 United Kingdom ..... 179/115.5 DV
893838 4/1962 United Kingdom ..... 179/115.5 PS

*Primary Examiner*—Thomas W. Brown
*Attorney, Agent, or Firm*—Andrus, Sceales, Starke & Sawall

[57] ABSTRACT

In a moving coil loudspeaker of the type including a pair of co-axial speech coils, one driving a cone and the other a high-frequency diaphragm at the rear of the loudspeaker, the speech coils operating in respective annular air gaps in series with one another and formed in a magnetic assembly comprising an outer ring magnet, a pair of annular magnetic plates fitted at the ends of the ring magnet and a central magnetic pole piece formed with an axial passage defining a horn for the acoustic output of the diaphragm and extending into the openings in the annular plates to define the two air gaps, the central pole piece is formed with an encircling flange forward of its rear end which is secured to the rear annular plate by way of a non-magnetic member to constitute the sole fixing for the pole piece.

3 Claims, 3 Drawing Figures

14
24
9
16
2
1
20
8
3
18
22
12
10
19
13
4

25
14
24
7
16
2
9
1
20
8
18
22
3
12
19
10
13
4

3
31
22
18
30
12
28
10
8

LOUDSPEAKER HAVING IMPROVED MAGNETIC ASSEMBLY

This invention relates to moving coil loudspeakers of the type including a pair of coaxial speech coils, one of which drives a cone for reproduction of the lower frequencies, while the other drives a high-frequency diaphragm at the rear of the loudspeaker.

The speech coils operate in respective annular air gaps in series with one another and formed in a magnetic assembly comprising an outer ring magnet, a pair of annular magnetic plates fitted at the ends of the ring magnet and a central magnetic pole piece formed with an axial passage defining a horn for the acoustic output of the diaphragm and extending into the openings in the annular plates to define the two air gaps. An example of such a construction is described and illustrated in British Pat. No. 893,838.

In such a construction the central pole piece has to be supported rigidly between the two annular end plates since it is important that the two air gaps should be defined with considerable accuracy. Since the central pole piece must, of course, be magnetically isolated from the two end plates, this involves an assembly of non-magnetic rings and spacers. In a typical form of construction such as that illustrated in the previously mentioned specification, the central pole is formed with opposed annular shoulders which are located in relation to the respective annular plates by the spacers just referred to. The accuracy of the location of the central pole within the openings in the annular plates thus depends largely on the accuracy of the spacers and on careful assembly. The width of each of the two separate air gaps needs to be carefully monitored.

According to the present invention, the central pole piece in a magnetic assembly for a loudspeaker of the type just described is formed with an encircling flange forward of its rear end which is secured to the rear annular plate by way of a non-magnetic member to constitute the sole fixing for the pole piece. This greatly facilitates the overall assembly since only a single non-magnetic spacing member is involved and, moreover, the fixing can be a positive one, e.g. by means of bolts or screws passing through the flange and spacing member and into the rear annular plate.

The encircling flange is preferably continuous, but may be interrupted so as effectively to form a number of spaced lugs if desired. The remainder of the components of the magnetic assembly may be held together in the usual way.

Since the flange secured to the rear annular plate by way of the non-magnetic spacer constitutes the sole fixing for the pole piece, there is no mechanical connection at all between the central pole piece and the forward annular plate and this makes it possible to reduce the axial length of the assembly as a whole and thus to replace the normal construction of ring magnet by a ferrite ring magnet of appreciably smaller axial length. The use of such a ferrite magnet leads to greater magnetic efficiency and overall economy and is made possible by the fixing of the central pole piece in accordance with the present invention.

A construction in accordance with the present invention provides a new approach to the problem of obtaining a comparatively higher total flux in the forward air gap for the speech coil of the cone of the loudspeaker, which is the main subject matter of the earlier specification No. 893,838. As described in this earlier specification, the result is achieved by the inclusion of a magnetic shunt which is integral with the material defining one wall of the air gap of the speech coil of the rear diaphragm and which is of small enough cross sectional area to be appreciably saturated by the magnetic flux. A similar result may be achieved in a construction in accordance with the present invention as a result of the shunting effect of the magnetic path passing through the flange on the central pole piece and then through the non-magnetic spacing member to the rear annular plate. The required degree of shunting is obtained by selecting the proportions of the cross sections of the flange and of the non-magnetic spacing member so as to give the magnetic path a reluctance of the required magnitude. This magnetic path may be regarded as an effective extension of the air gap, this extension reducing the overall reluctance of the magnetic circuit so as to give increased flux at the air gap for the speech coil of the cone and at the same time bypassing a corresponding proportion of the total magnetic flux so that the speech coil for the rear diaphragm works in a relatively smaller total flux.

An example of a loudspeaker in accordance with the invention will now be described with reference to the accompanying drawings, in which.

Figure 2:
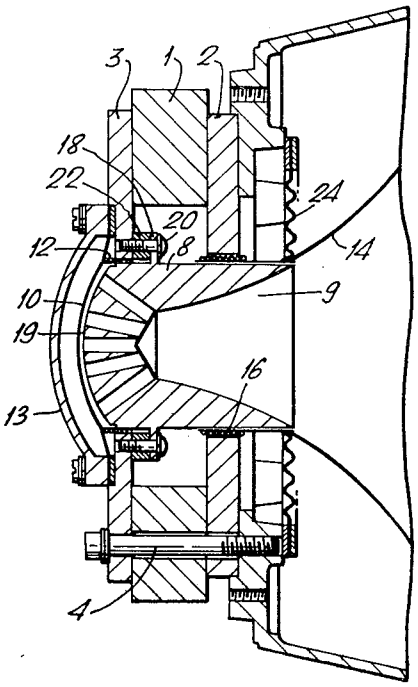
FIG. 2 is a similar view, but showing parts at the rear of the loudspeaker after assembly is complete.

The main components of the magnetic assembly of the loudspeaker shown in the drawings are basically the same as those in previous constructions in that they comprise a ring magnet 1, annular front and rear plates 2 and 3 glued to the magnet 1, and secured to the frame of the loudspeaker, shown as 7, by bolts 4, only one of which is seen in the drawings, together with a central pole piece 8 formed with a central passage 9 defining a horn for the acoustic output of a diaphragm 10. The diaphragm 10 is driven by a speech coil 12 operating in an annular air gap between the rear plate 3 and the central pole piece 8 and enclosed by a cover 13. A cone 14 is driven by a speech coil 16 operating in an air gap between the front plate 2 and the central pole piece 8.

Figure 1:
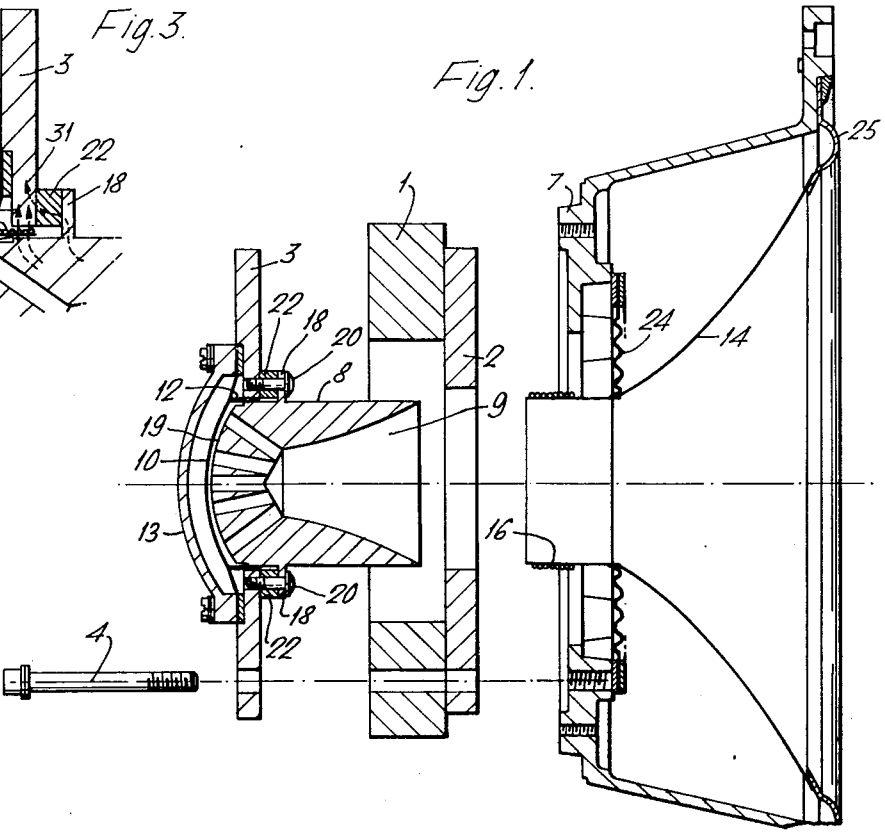
FIG. 1 is an exploded longitudinal sectional view showing the components of the loudspeaker during course of assembly.

Instead of being fixed between the plates 2 and 3 as in previous constructions of loudspeakers of this type, the central pole piece 8 is formed with a thin flange 18 spaced forwardly from the rear end 19 of the pole piece. As best seen form FIG. 1, the pole piece is secured by means of screws 20 passing through the flange 18 and then through a non-magnetic spacing ring 22 into the rear plate 3. Since the flange 18, the spacer ring 22 and the rear plate 3 can be machined with considerable accuracy, the axial position of the pole piece 8 is automatically determined and no gauging of this is required during assembly. Once the pole piece 8 has been secured to the rear plate 3 as illustrated in FIG. 1, the rear plate is glued to the remainder of the magnetic assembly in a simple assembly jig which automatically centres the pole piece 8 within the central opening in the front plate 2. The glued assembly is then bolted to the frame 7.

The spacer ring 22 which needs to be made of non-magnetic material may conveniently be made of aluminium and, as previously described, the reduced length of the magnetic assembly as a whole makes it possible for the ring magnet 1 to be made of ferrite with consequent economy and increase in efficiency. The cone 14 is mounted in the usual way by means of a surround 24 in the region of the speech coil 16 and by a further surround 25 at its outer edge. Owing to the shorter length of the horn 9 and its correspondingly reduced response at its lower frequency limit, the cone 14 needs to have an increased high frequency response and is therefore preferably vacuum-formed from sheet plastics material.

Figure 3:
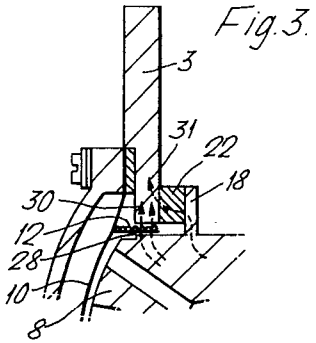
FIG. 3 is a detailed view to an enlarged scale of part of FIG. 2 illustrating the effect of a magnetic shunt.

As previously described, the air gaps within which the speech coils 12 and 16 operate are in series with one another, but the total flux in the forward air gap in which the speech coil 16 operates is higher owing to the presence of a magnetic shunt in the region of the air gap in which the speech coil 12 operates, as illustrated in FIG. 3. The air gap itself is shown as 28 and magnetic flux passing directly across the air gap from the pole piece 8 to the outer plate 3 is indicated by the pair of arrows shown as 30. An alternative magnetic path as indicated by the arrow 31 extends through the flange 18 and non-magnetic spacer ring 22 and may be regarded as an effective extension of the air gap thus reducing the overall reluctance of the magnetic circuit so as to give increased flux at the air gap for the speech coil 16 driving the cone 14. The fact that a portion of the magnetic flux follows the path of the arrow 31 bypasses that portion of the total magnetic flux so that the speech coil 12 works in the smaller remaining flux. By selecting the dimensions of the flange 18 and the spacer ring 22 the magnitude of the bypassing flux can be adjusted accordingly as can the ratio of the magnetic fluxes for the two speech coils 12 and 16.

As a result of the construction just described, the loudspeaker has a performance which is directly comparable with a similar loudspeaker manufactured as illustrated in British Pat. No. 893,838, but with fewer parts in the magnetic assembly and resultant economy arising both from the simplied assembly and the use of a ferrite ring magnet 1.

We claim:

1. In a moving coil loudspeaker of the type including a magnetic assembly comprising a ring magnet, front and rear annular magnetic plates fitted at the ends of said ring magnet and a central magnetic pole piece formed with an axial passage defining a horn, said pole piece extending into the openings in said annular plates to define first and second axially spaced annular air gaps in series with one another, first and second co-axial speech coils, said speech coils operating in said respective air gaps, a cone driven by said first speech coil, and a high frequency diaphragm driven by said second speech coil to provide acoustic output to said horn, the improvement comprising said central pole piece being formed with an encircling flange forward of its rear end and proximate the rear annular plate, a non-magnetic member interposed between said flange and rear annular plate, and means securing said flange to said rear annular plate by way of said non-magnetic member to constitute the sole fixing for said pole piece.

2. A moving coil loudspeaker according to claim 1, in which said flange on said pole piece is continuous.

3. A moving coil loudspeaker according to claim 1 in which said ring magnet is made of ferrite.

* * * * *